US006619706B2

(12) United States Patent
Mackie

(10) Patent No.: US 6,619,706 B2
(45) Date of Patent: Sep. 16, 2003

(54) CABINET EARTHQUAKE LATCH ASSEMBLY

(75) Inventor: Stuart Mackie, Whittier, CA (US)

(73) Assignee: Gryphon Corporation, Sylmar, CA (US)

( * ) Notice: Subject to any disclaimer, the term of this patent is extended or adjusted under 35 U.S.C. 154(b) by 0 days.

(21) Appl. No.: 09/924,364

(22) Filed: Aug. 7, 2001

(65) Prior Publication Data

US 2003/0030285 A1 Feb. 13, 2003

(51) Int. Cl.[7] ..... E05C 3/02

(52) U.S. Cl. ..... 292/194; 292/130; 292/215; 292/230; 292/DIG. 22

(58) Field of Search ..... 292/DIG. 22, 194, 292/215, DIG. 65, 120, 130, 131, 136, 218, 230

(56) References Cited

U.S. PATENT DOCUMENTS

| | | | | | |
|---|---|---|---|---|---|
| 882,296 | A | * | 3/1908 | Carroll | 292/130 |
| 2,476,563 | A | * | 7/1949 | Pirl et al. | 403/230 |
| 3,397,001 | A | * | 8/1968 | Friedman | 292/87 |
| 4,505,526 | A | * | 3/1985 | Leck | 312/333 |
| 4,739,896 | A | * | 4/1988 | Moss | 220/18 |
| 5,035,451 | A | * | 7/1991 | Brady | 292/96 |
| 5,335,986 | A | * | 8/1994 | Hartrum et al. | 312/220 |
| 5,388,901 | A | * | 2/1995 | Asano | 312/222 |
| 5,611,579 | A | * | 3/1997 | Kreitenberg | 292/130 |
| 5,626,372 | A | * | 5/1997 | Vogt | 292/87 |
| 5,697,655 | A | * | 12/1997 | Strong | 292/230 |
| 6,109,708 | A | * | 8/2000 | Walla et al. | 312/216 |

* cited by examiner

*Primary Examiner*—William Miller
*Assistant Examiner*—Carlos Lugo
(74) *Attorney, Agent, or Firm*—Townsend and Townsend and Crew LLP

(57) ABSTRACT

A cabinet earthquake latch assembly designed to be attached on a cabinet inner surface and a back surface of a cabinet door. The cabinet earthquake latch assembly includes a door arm, a cam and a strike. When in use, the door arm is attached to the cabinet door, the cam is rotatably attached to the door arm and the strike is attached to the cabinet inner surface. The cam and strike are configured and attached to the door arm and cabinet inner surface such that the cam collides with the strike when the cabinet door is being initially opened at at least a predetermined speed (e.g., a speed generated in an earthquake). This collision causes the cam to rotate from a rest position and then to become lodged against the strike in a rotated position, thus preventing further opening of the cabinet door.

11 Claims, 9 Drawing Sheets

CABINET EARTHQUAKE LATCH ASSEMBLY

BACKGROUND OF THE INVENTION

1. Field of the Invention

The present invention relates, in general, to cabinet latches and, in particular, to cabinet earthquake latches.

2. Description of the Related Art

During an earthquake, the doors of cabinets are frequently jolted open and the cabinet contents (e.g., jars, glassware, china and cans) consequently ejected, causing damages to the contents and/or injury to persons. Standard cabinet latches offer little protection from such damage or injury since the forces generated during an earthquake often overcome (i.e., release) a standard cabinet latch.

Over the years, cabinet earthquake latches that employ various combinations of levers, springs and pushbuttons have been developed, in response to the forgoing problem. These conventional cabinet earthquake latches are configured such that the forces generated during an earthquake are not able to release the latch. Conventional cabinet earthquake latches can, however, be released using a specific operating procedure. Since release requires a specific operating procedure, such conventional cabinet earthquake latches also function as child safety cabinet latches.

Conventional cabinet earthquake latches, however, suffer from several drawbacks. Many require more than one hand to operate. For example, a specific operating procedure may require that one hand be used to press a pushbutton or move a lever, while the other hand is opening the cabinet door. As a consequence, a user is precluded from performing routine tasks, such as opening a cabinet door with one hand while placing contents held in the other hand into the cabinet. Conventional cabinet earthquake latches are also often visible from outside of the cabinet, resulting in an unattractive appearance. Furthermore, frequently conventional cabinet earthquake latches are functional with only certain configurations of cabinets (e.g., cabinets with inner lips of a predetermined size).

Still needed in the field, therefore, is a cabinet earthquake latch that can be operated with one hand, is functional with a wide variety of cabinet configurations and is not visible from outside of the cabinet.

BRIEF SUMMARY OF THE INVENTION

The present invention provides a cabinet earthquake latch assembly designed to be attached on an inner surface of a cabinet (hereinafter referred to as a "cabinet inner surface") and a back surface of a cabinet door, thereby making it invisible from outside of the cabinet. The cabinet earthquake latch assembly can be operated with one hand and is functional with a wide variety of cabinet configurations.

One exemplary embodiment of the present invention includes a door arm, a cam and a strike. When the cabinet earthquake latch assembly is in use, the door arm is attached to a back surface of the cabinet door, the cam is rotatably attached to the door arm and the strike is attached to the cabinet inner surface.

The cam and strike are configured and attached to the door arm and cabinet inner surface such that the cam collides with the strike when the cabinet door is being initially opened at at least a predetermined speed (e.g., a cabinet door speed that would result from forces generated in an earthquake that are strong enough to cause movement of cabinet contents).

This collision causes rotation of the cam from a rest position. The cam then becomes lodged against the strike in a rotated position, thus preventing further opening of the cabinet door. However, when the cabinet door is initially opened at less than the predetermined speed, the cam collides with the strike and is rotated from the rest position. But, the cam then rotates back towards the rest position and, thereafter, clears the strike during further opening of the cabinet door.

The rotational response of the cam to the speed, at which the cabinet door is opened, determines whether the cam will become lodged against the strike (and thus prevent further opening of the cabinet door) or clear the strike (and thus allow further opening of the cabinet door). When the cabinet door is opened at at least a predetermined speed (i.e., opened quickly), the cam is rotated from a rest position by its collision with the strike and becomes lodged against the strike before it is able to return to the rest position. However, when the door is opened at less than the predetermined speed (i.e., opened slowly), the cam is rotated by its collision with the strike but then is able to return to the rest position and clear the strike. Whether or not the cam becomes lodged against the strike or clears the strike is, therefore, a function of the speed at which the door is opened.

Since the operation of earthquake cabinet latch assemblies according to the present invention is based on the rotational response of the cam, they can be operated with only one hand (or even one finger). In addition, since the door arm can be attached to the cabinet inner surface and a back surface of the cabinet door, earthquake cabinet latch assemblies of the present invention are not visible from outside of the cabinet and can be used with a wide variety of cabinet configurations.

A better understanding of the features and advantages of the present invention will be obtained by reference to the following detailed description that sets forth illustrative embodiments, in which the principles of the invention are utilized, and the accompanying drawings.

BRIEF DESCRIPTION OF THE DRAWINGS

In FIG. 4, the cam is at a rest position with the cabinet door closed.

In FIG. 5, the cabinet door is being opened and the cam is just colliding with the strike.

In FIG. 6, the cabinet door has been initially opened such that the cam is rotated from a rest position.

In FIG. 7, the cam is lodged against the strike.

In FIG. 8, the cam has returned to the rest position and is thus able to clear the strike as the cabinet door is further opened.

DESCRIPTION OF EXEMPLARY EMBODIMENTS OF THE INVENTION

Figure 3A:
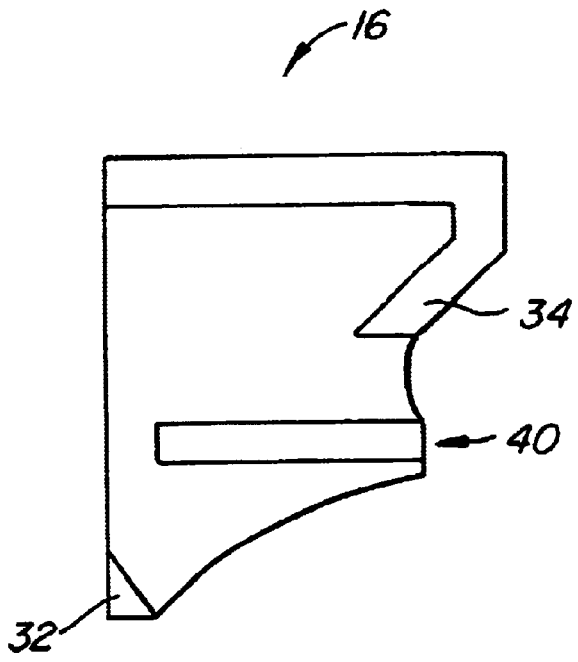
FIGS. 3A–3C are cross-sectional side, front and bottom views, respectively, of a strike of a cabinet earthquake latch assembly according to one exemplary embodiment of the present invention.
Figure 3B:
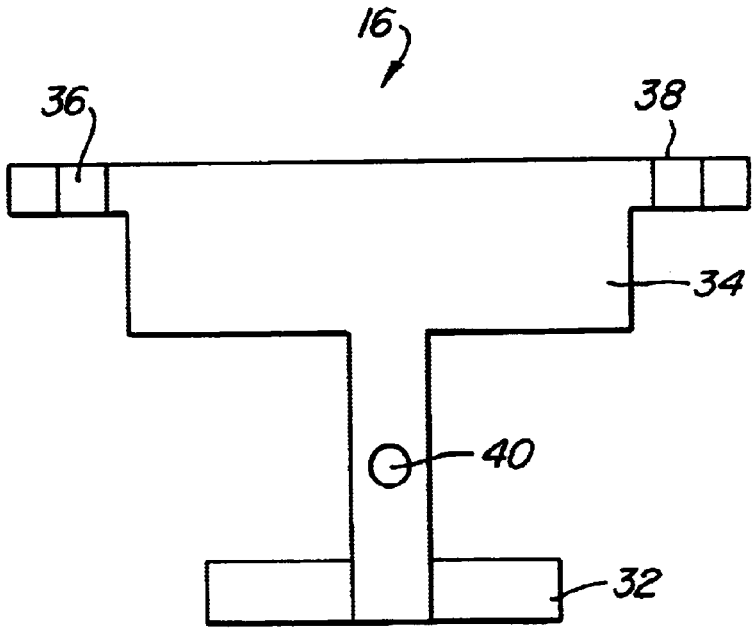
Figure 3C:
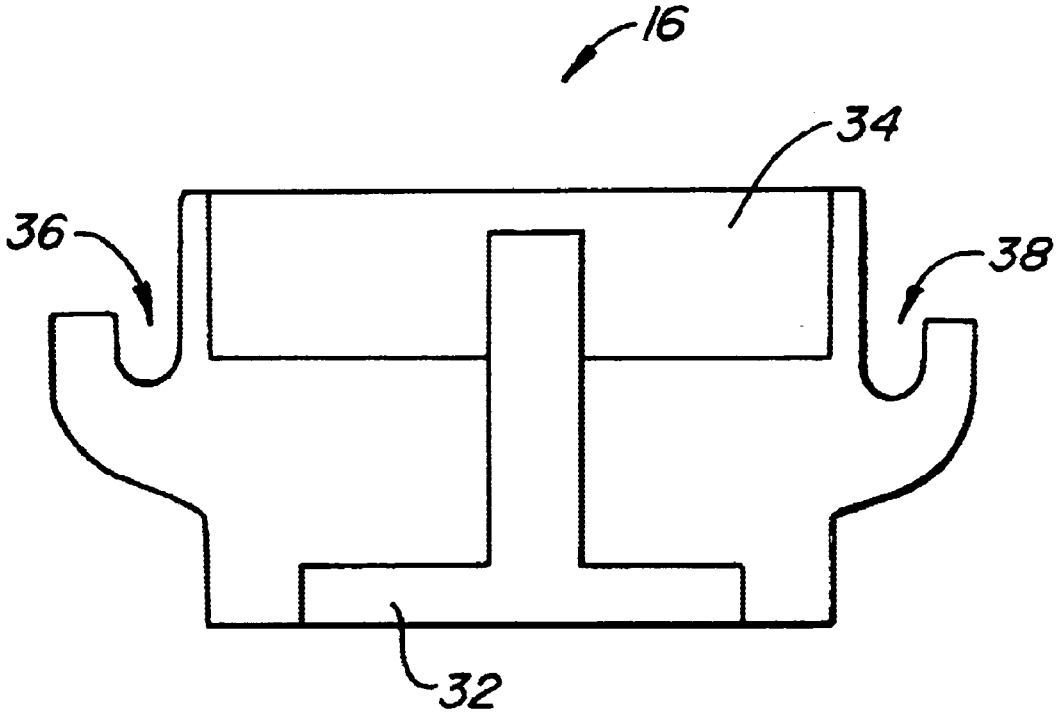
Figure 4:
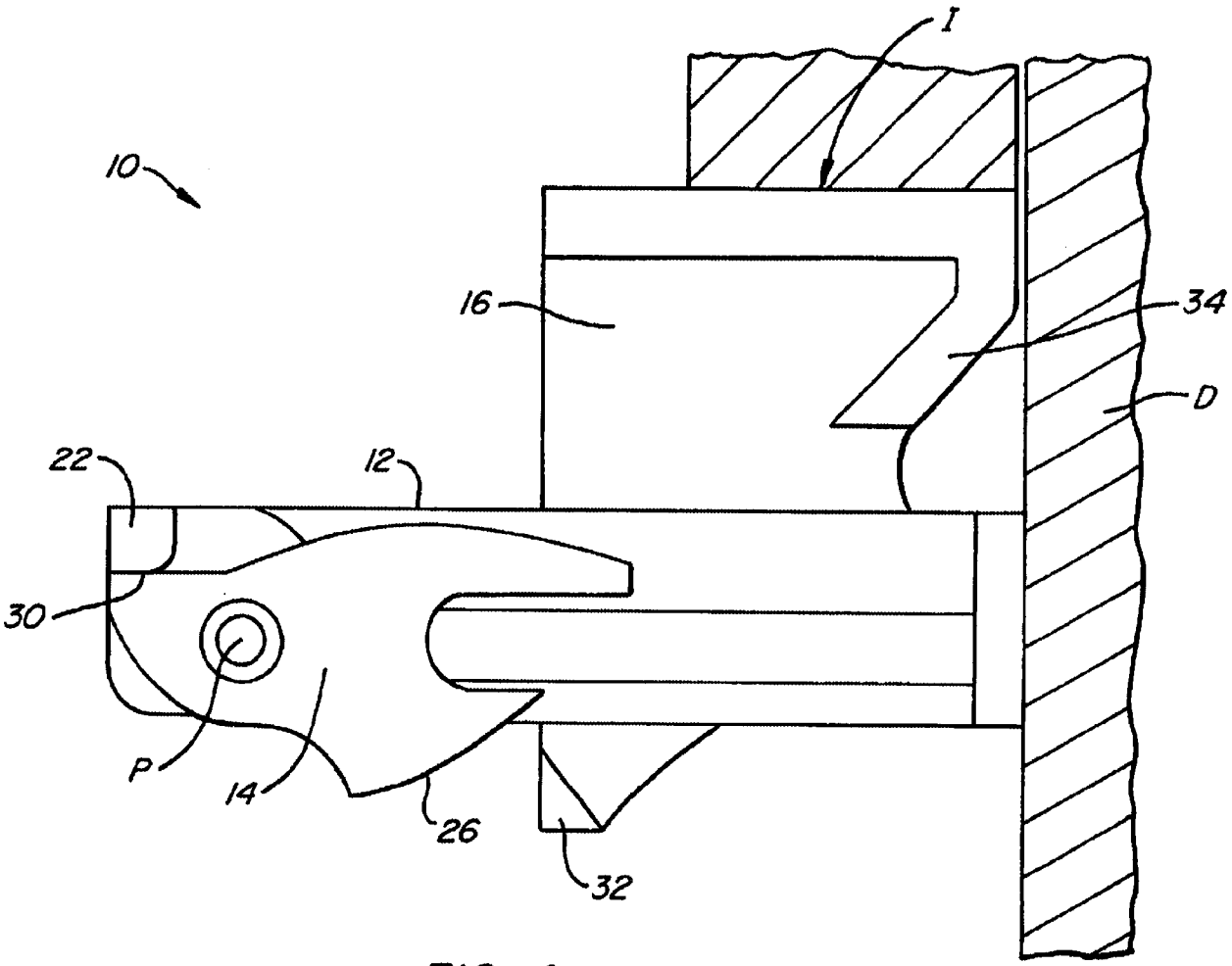
FIG. 4 is a side view of a cabinet earthquake latch assembly according to one exemplary embodiment of the present invention with the cam rotatably attached to the door arm, the door arm attached to a back surface of a cabinet door and the strike attached to a cabinet inner surface.

FIGS. 1A–4 are illustrations of one exemplary embodiment of a cabinet earthquake latch assembly 10 for use on a cabinet with a cabinet inner surface (labeled I in FIG. 4) and a back surface of a cabinet door (labeled D in FIG. 4). Cabinet earthquake latch assembly 10 includes a door arm 12, a cam 14 and a strike 16. Door arm 12, cam 14 and strike 16 can be formed, for example, of injection molded plastic and are, therefore, relatively inexpensive to manufacture.

Figure 1A:
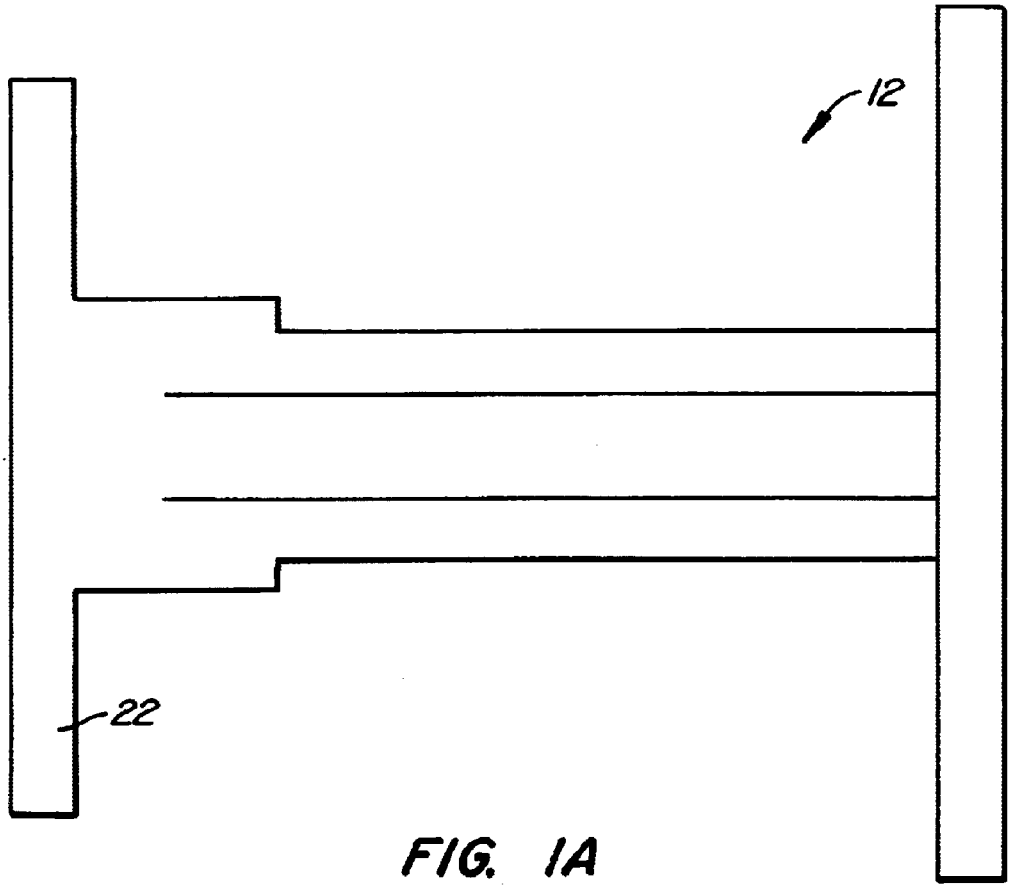
FIGS. 1A–1C are top, side and cross-sectional end views, respectively, of a door arm of a cabinet earthquake latch assembly according to one exemplary embodiment of the present invention.
Figure 1B:
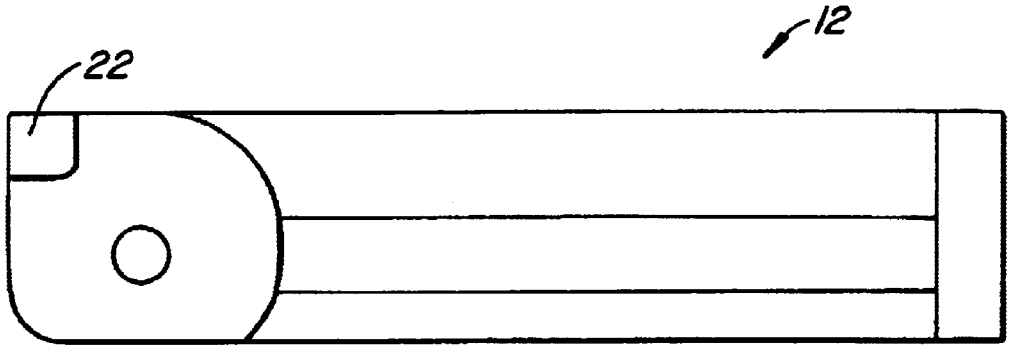
Figure 1C:
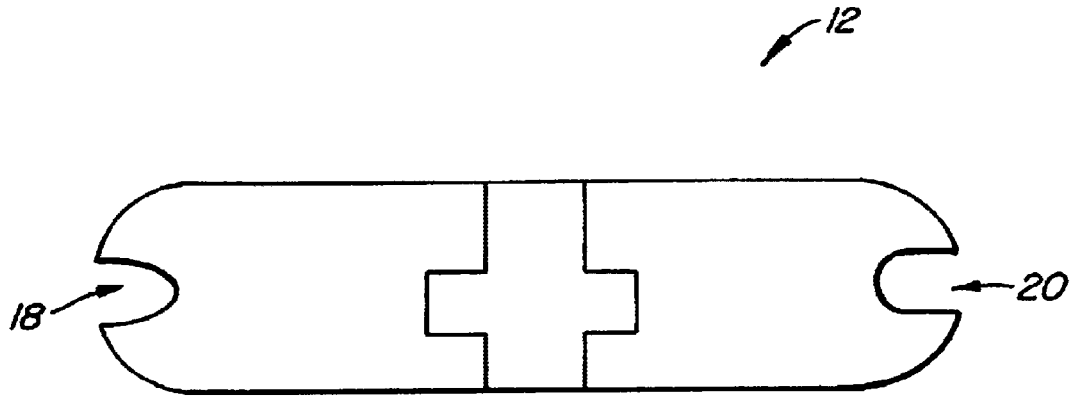

FIGS. 1A–1C are top, side and cross-sectional end views, respectively, of door arm 12, which is configured for attachment at a suitable attachment location on the back surface of cabinet door D when cabinet earthquake latch assembly 10 is in use. Door arm 12 can be attached to the back surface of the cabinet door D using screws (not shown) inserted through door arm openings 18 and 20 included in door arm 12, as illustrated in FIG. 1C. Door arm 12 includes a cam stop portion 22, the function of which is explained below.

Cam 14 is configured to be rotatably attached to door arm 12 when cabinet earthquake latch assembly 10 is in use, as illustrated in FIG. 4. Cam 14 is rotatably attached to door arm 12 at a pivot point of the cam (labeled P in FIG. 4) that is offset from the center of gravity of cam 14. Cam 14 is, therefore, attached to door arm 12 in a manner that allows cam 14 to rotate about pivot point P. However, cam stop portion 22 of door arm 12 serves to limit gravity-induced rotation of cam 14 and to define the rest position of cam 14, as shown in FIG. 4. Cam 14 can be attached to door arm 12 using, for example, a screw placed in countersunk opening 23.

Cam 14 also includes a cam opening 24, a convex cam lower surface 26, a concave cam lower surface 28 and a flat upper surface 30. When cam 14 is in the rest position, flat upper surface 30 abuts cam stop portion 22, as illustrated in FIG. 4. FIG. 4 depicts cabinet earthquake latch assembly 10 in use with the back surface of the cabinet door D in a closed position. Therefore, in FIG. 4, cam 14 is in a rest position determined by (i) gravity, (ii) pivot point P being off-set from the center of gravity of cam 14 and (iii) cam stop portion 22.

Figure 2:
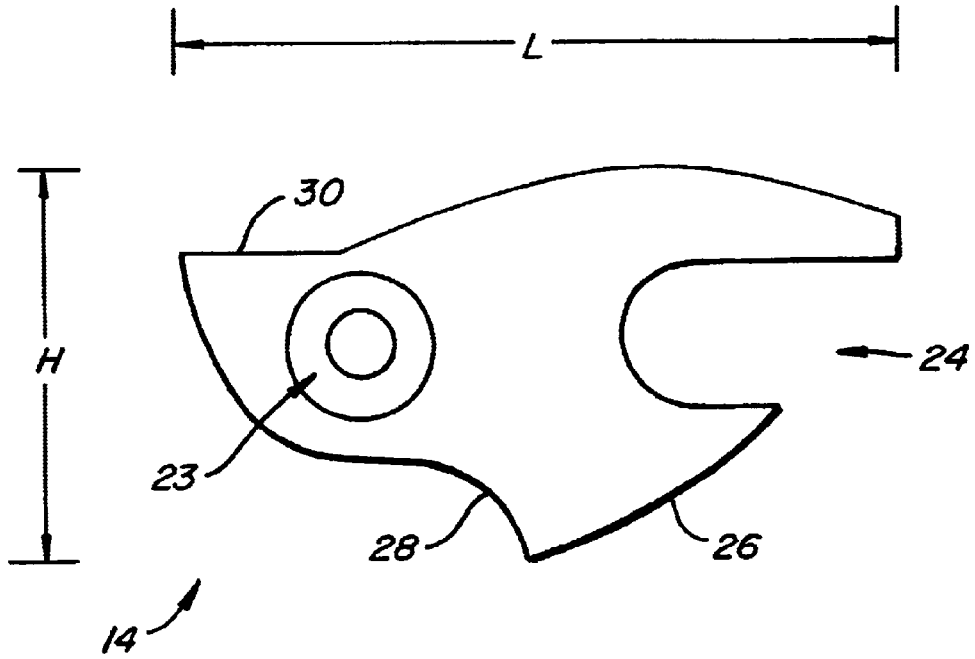
FIG. 2 is a side view of a cam of a cabinet earthquake latch assembly in accordance with one exemplary embodiment of the present invention.

Cam 14 can have an overall length L of 1.025 inches, a height H in the rest position 0.525 inches and a thickness of 0.25 inches (see FIG. 2, where the dimensions L and H are marked). Furthermore, convex cam lower surface 26 can have a 1.00 inch radius of curvature and concave cam lower surface 28 can have a 0.150 inch radius of curvature.

Strike 16 is configured for attachment to cabinet inner surface I when cabinet earthquake latch assembly 10 is in use. Strike 16 includes a skid portion 32 and a locking portion 34. Strike 16 can be attached to cabinet inner surface I using screws (not shown) inserted through strike openings 36 and 38 provided in strike 16, as illustrated in FIGS. 3B and 3C.

Strike 16 also includes an alignment opening 40 that extends partially through strike 16, as shown in FIGS. 3A and 3B. Alignment opening 40 is positioned in strike 16 such that when strike 16 is attached to cabinet inner surface I and cabinet door D is closed, alignment opening 40 is aligned with a suitable attachment location on the back surface of cabinet door D for door arm 12.

As is well known to one skilled in the art, cabinets can be configured with either left-handed or right-handed hinge positions. Door arm 12, cam 14 and strike 16 are configured to possess left and right-handed symmetry in order that cabinet earthquake latch assembly 10 can be used on a cabinet with either left-handed or right-handed hinges. This left and right-handed symmetry enables the cabinet earthquake latch assembly to function on a cabinet regardless of hinge position.

Figure 5:
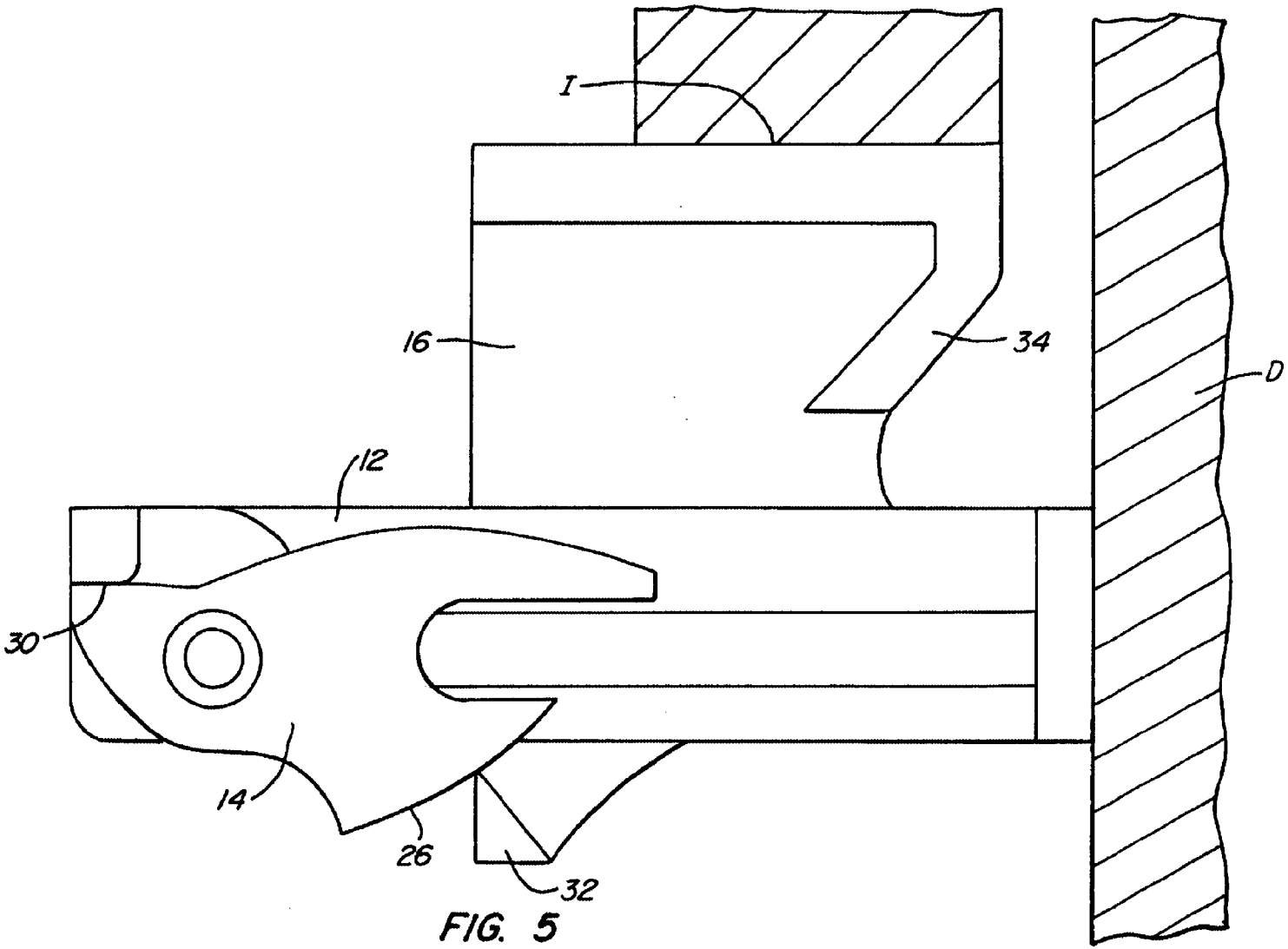
FIG. 5 is a side view of a cabinet earthquake latch assembly according to the present invention with the cam rotatably attached to the door arm, the door arm attached to a back surface of a cabinet door and the strike attached to a cabinet inner surface.

FIG. 5 depicts cabinet earthquake latch assembly 10 when cabinet door D is in the process of being initially opened (i.e., being opened only a small distance, for example, less than 0.125 inches). Regardless of the speed at which cabinet door D is opened, cam 14 and strike 16 are configured and attached to door arm 12 and cabinet inner surface I, respectively, such that convex cam lower surface 26 of cam 14 collides with skid portion 32 of strike 16.

Figure 6:
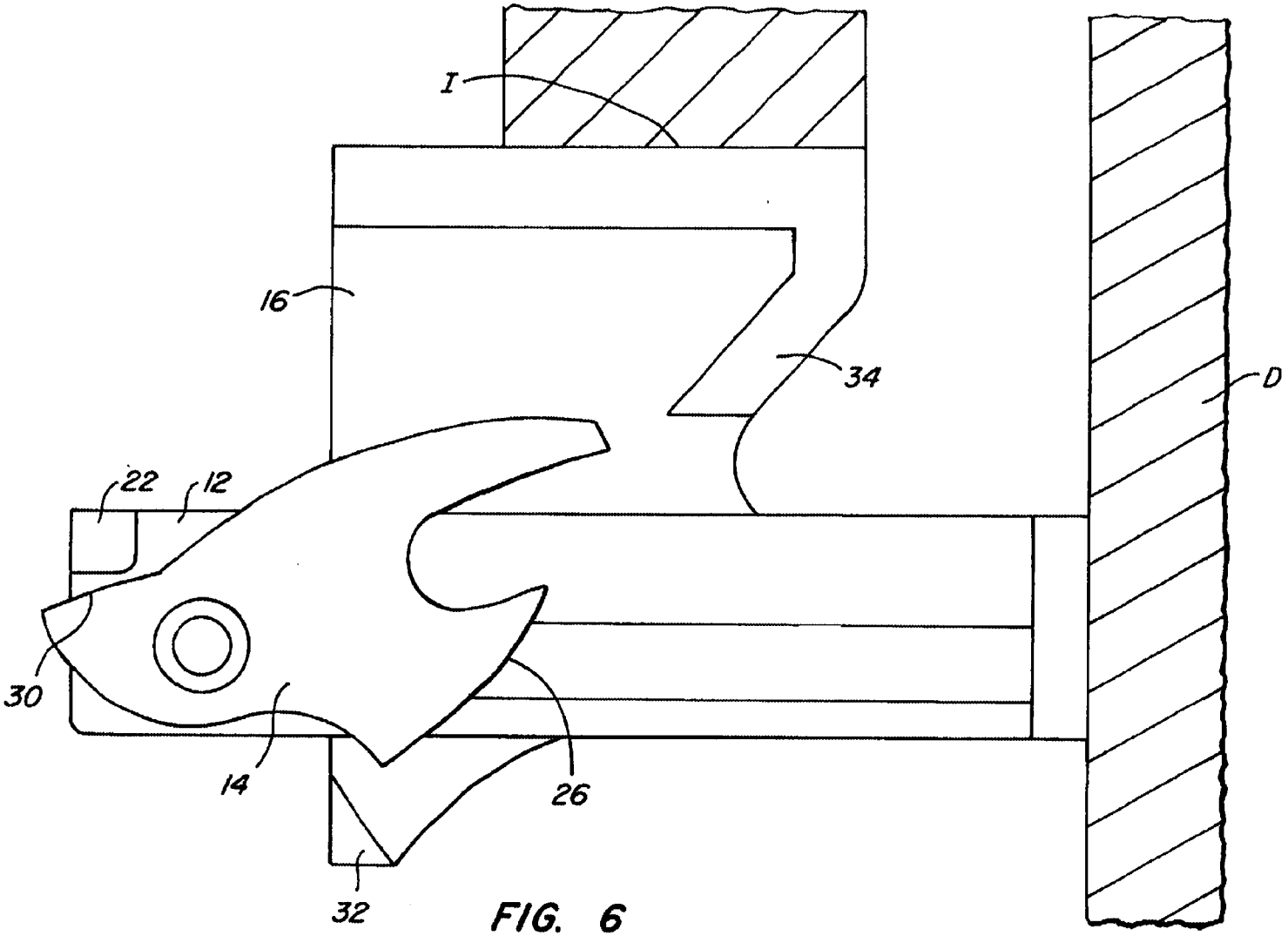
FIG. 6 is a side view of a cabinet earthquake latch assembly according to one exemplary embodiment of the present invention with the cam rotatably attached to the door arm, the door arm attached to a back surface of a cabinet door and the strike attached to a cabinet inner surface.

Since cam 14 is rotatably attached to door arm 12, convex cam lower surface 26 rides along skid portion 32 and cam 14 rotates in a counter-clockwise direction from the rest position as cabinet door D is initially opened. Convex cam lower surface 26 is curved to facilitate such a rotation of cam 14. The force of the collision also serves to induce a rotating motion in cam 14 that is maintained even after convex cam lower surface 26 is no longer in contact with skid portion 32, as illustrated in FIG. 6.

Figure 7:
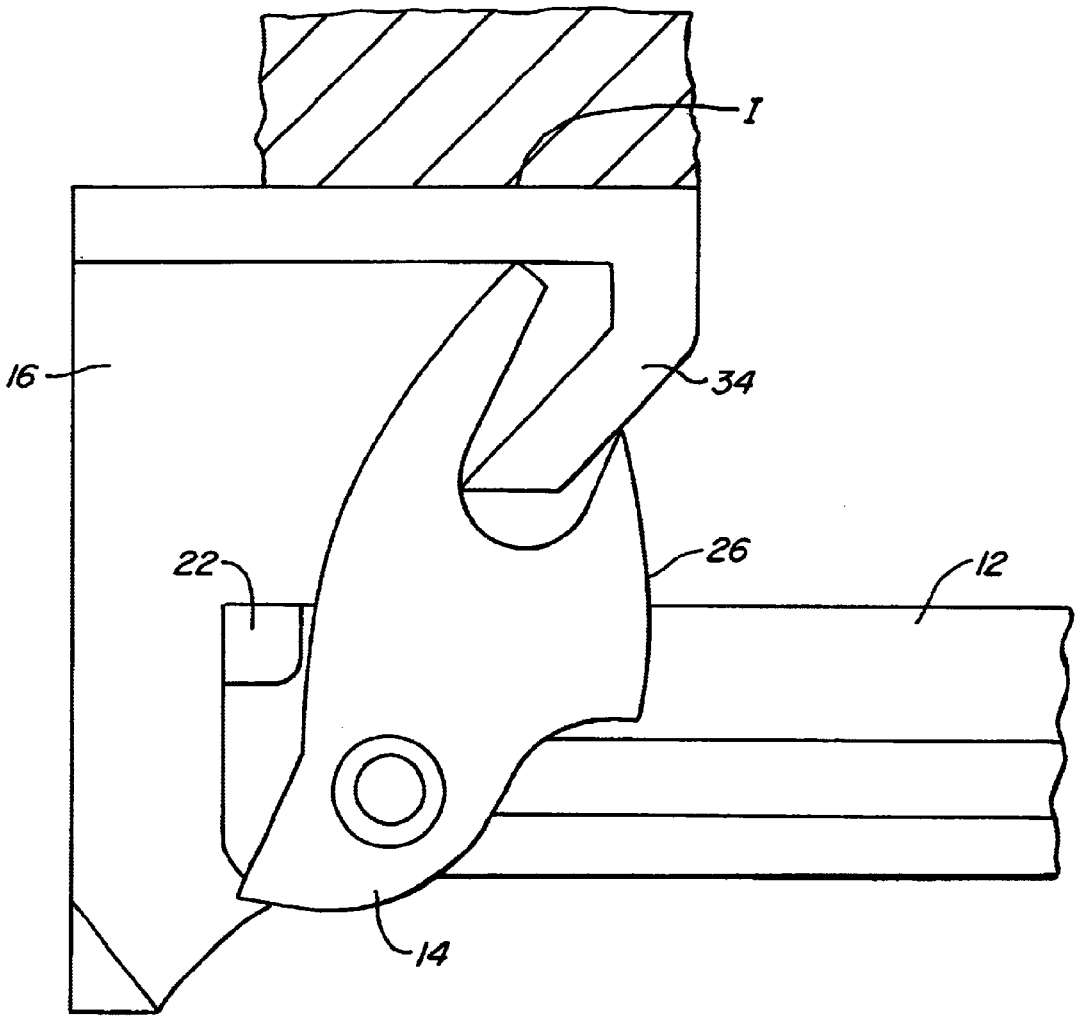
FIG. 7 is a side view of a cabinet earthquake latch assembly according to one exemplary embodiment of the present invention with the cam rotatably attached to the door arm, the door arm attached to a back surface of a cabinet door (not shown in FIG. 7) and the strike attached to a cabinet inner surface.

In the circumstance that cabinet door D is being opened at at least a predetermined speed (i.e., at a relatively high speed that is equal to or greater than a speed induced on the cabinet door by forces generated in an earthquake that are strong enough to cause movement of cabinet contents), cam opening 24 is sufficiently rotated to become lodged (i.e., latched) against locking portion 34 of strike 16 with cam 14 in a rotated position (see FIG. 7). Since cam opening 24 is lodged against locking portion 34, further opening of cabinet door D is prevented. Since the cabinet door is prevented from opening fully, damage to cabinet contents or persons due to ejection of the cabinet contents is barred.

When cam opening 24 is lodged against locking portion 34, cabinet door D will be open to a slight extent. The extent to which cabinet door D is open depends on the width of cabinet door D and the distance between the cabinet earthquake latch assembly and the hinges of cabinet door D. However, a typical distance that cabinet door D will be open is only in the range of 1.00 inches to 1.50 inches.

Figure 8:
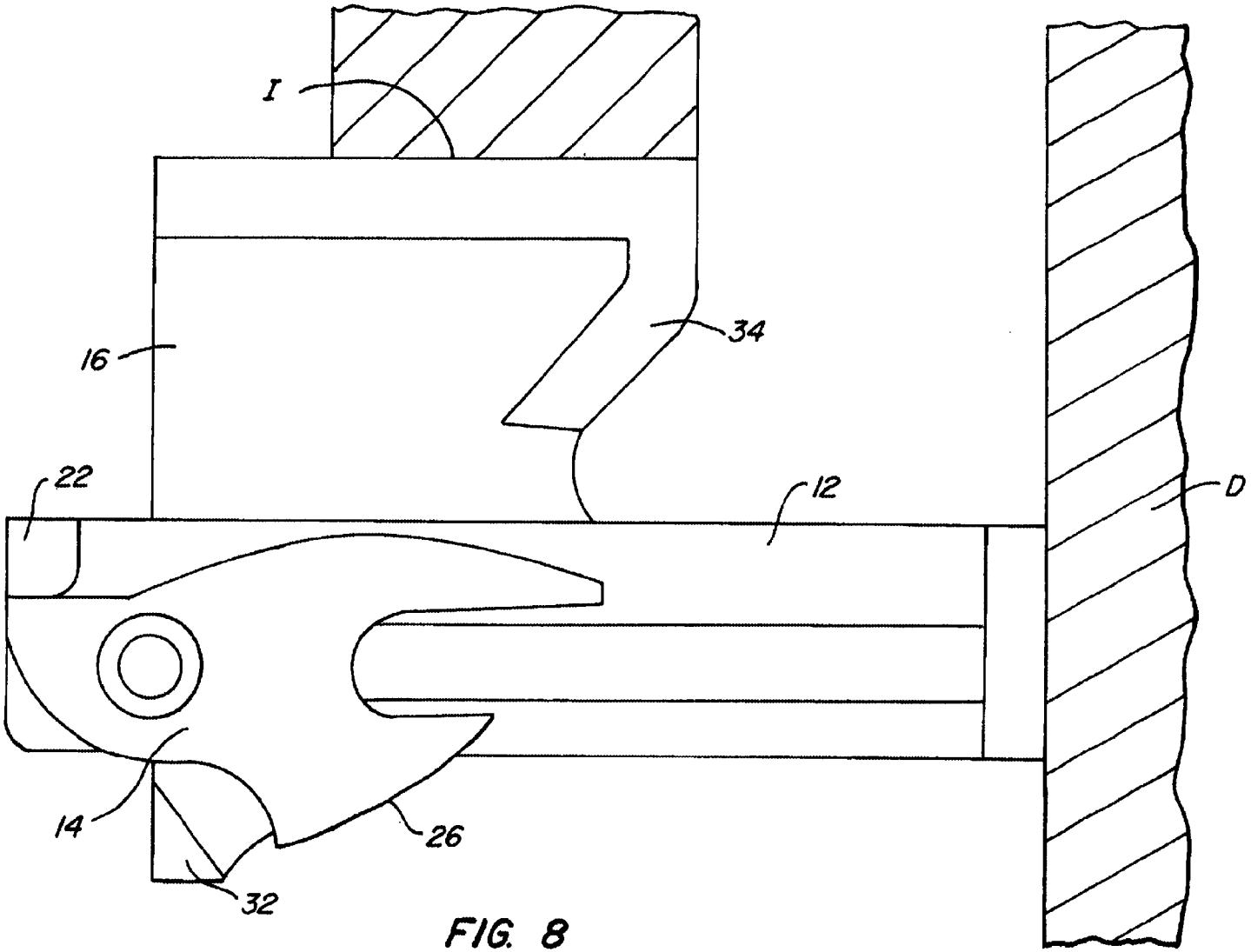
FIG. 8 is a side view of a cabinet earthquake latch assembly according to the one exemplary embodiment of the present invention with the cam rotatably attached to the door arm, the door arm attached to a back surface of a cabinet door and the strike attached to a cabinet inner surface.

In the circumstance where cabinet door D is opened at less than the predetermined speed (i.e., at a speed that is less than a speed induced on the cabinet door by forces generated in an earthquake that are strong enough to cause movement of cabinet contents), convex cam lower surface 26 of cam 14 will collide with skid portion 32 of strike 16, as depicted in FIG. 5. Furthermore, this collision will result in cam 14 being rotated from the rest position (see FIG. 6). However, since cabinet door D is being opened at less than the predetermined speed (i.e., being opened slowly), cam 14 is able to return to the rest position (by rotating under the influence of gravity) without becoming lodging against strike 16, as shown in FIG. 8. Cam 14 is, thereafter, able to clear strike 16 during further opening of cabinet door. D In this regard, the vertical distance between skid portion 32 and locking portion 34 is predetermined such that cam 14 can pass between the skid portion and the locking portion when cabinet door D is opened at less than the predetermined speed.

When cabinet earthquake latch assembly 10 is in use, a user can fully open cabinet door D with one hand (or even one finger) by merely pulling cabinet door D open at a speed that is less than the predetermined speed. However, should cabinet door D be jolted open during an earthquake at a speed that is equal to or greater than the predetermined speed, cabinet earthquake latch assembly 10 will prevent cabinet door D from opening more than a slight extent.

When cabinet door D is being closed from a fully open position, concave cam lower surface 28 is configured to collide with skid portion 32 and facilitate rotation of cam 14, thus allowing cabinet door D to fully close.

Alignment opening 40 of strike 16 is configured to contain a nail such that the nail protrudes from alignment opening 40. Alignment opening 40 can, therefore, aid in the proper attachment of door arm 12 to cabinet door D in the following manner. Strike 16 is first attached to cabinet inner surface I. A nail is then placed in alignment opening 40 such that the pointed end of the nail is slightly protruding from alignment opening 40 and the head of the nail is abutted against strike 16. Cabinet door D is then forcibly closed. The pointed end of the nail will have marked a suitable attachment location on the back surface of cabinet door D for door arm 12.

It should be understood that various alternatives to the embodiments of the invention described herein may be employed in practicing the invention. For example, the configuration (e.g., shape) and attachment of the cam, strike and door arm can be altered from that described herein. It is intended that the following claims define the scope of the invention and that structures within the scope of these claims and their equivalents be covered thereby.

What is claimed is:

1. A cabinet earthquake latch assembly for use on a cabinet comprising:

a door arm configured for attachment to a back surface of a cabinet door;

a cam configured for rotatable attachment to the door arm, the cam comprising:

a cam opening; and a convex cam lower surface;

a strike configured for attachment to an inner surface of the cabinet, the strike comprising:

a skid portion; and a locking portion;

wherein the cam collides with the strike when the cabinet door is being initially opened at at least a predetermined speed, thereby causing rotation of the cam from a rest position, the cam thereafter becoming lodged against the strike in a rotated position, thus preventing further opening of the cabinet door, wherein the cam collides with the strike when the cabinet door is initially opened at less than the predetermined speed, thereby causing rotation of the cam from the rest position, the cam thereafter clearing the strike during further opening of the cabinet door, and wherein the convex cam lower surface collides with the skid portion when the cabinet door is being initially opened at at least a predetermined speed thereby causing rotation of the cam from the rest position, the cam opening thereafter becoming lodged against the locking portion with the cam in a rotated position, thus preventing further opening of the cabinet door.

2. The cabinet earthquake latch assembly of claim 1, wherein the cam collides with the skid portion when the cabinet door is being initially opened at at least a predetermined speed thereby causing rotation of the cam from the rest position, the cam thereafter becoming lodged against the locking portion in a rotated position, thus preventing further opening of the cabinet door.

3. The cabinet earthquake latch assembly of claim 2, wherein the cam collides with the skid portion when the cabinet door is opened at less than the predetermined speed thereby causing rotation of the cam from the rest position, the cam thereafter clearing the strike during further opening of the cabinet door by passing between the skid portion and the locking portion.

4. The cabinet earthquake latch assembly of claim 1, wherein the cam further includes:

a concave cam lower surface;

wherein the concave cam lower surface collides with the skid portion when the cabinet door is being closed thereby causing rotation of the cam.

5. The cabinet earthquake latch assembly of claim 1, wherein the door arm is attached to a suitable attachment location on the back surface of the cabinet door, and wherein the strike includes an alignment opening partially therethrough, and wherein the alignment opening is positioned in the strike such that when the strike is attached to the cabinet inner surface and the cabinet door is closed, the alignment opening is aligned with the suitable attachment location of the door arm.

6. The cabinet earthquake latch assembly of claim 5, wherein the alignment opening is configured to contain a nail such that the nail protrudes from the alignment opening.

7. The cabinet earthquake latch assembly of claim 1, wherein the cam is rotatably attached to the door arm at a pivot point of the cam that is offset from a center of gravity of the cam.

8. The cabinet earthquake latch assembly of claim 7, wherein the door arm includes a cam stop portion configured to limit rotation of the cam and thereby define the rest position of the cam.

9. The cabinet earthquake latch assembly of claim 1, wherein the strike includes:

a skid portion; and a locking portion;

wherein the skid portion and the locking portion are spaced apart by a distance sufficient to provide clearance for the cam to pass therebetween when the cam is in the rest position.

10. The cabinet earthquake latch assembly of claim 1, wherein the predetermined speed is a speed that is induced on the cabinet door by forces generated in an earthquake that are strong enough to cause movement of cabinet contents.

11. The cabinet earthquake latch assembly of claim 1, wherein the door arm, strike and cam are each have left and right-handed symmetry.

* * * * *